United States Patent [19]

Yin

[11] Patent Number: 4,591,678

[45] Date of Patent: May 27, 1986

[54] HIGH POWER SWITCHING APPARATUS

[75] Inventor: Simon Yin, Fremont, Calif.

[73] Assignee: Square D Company, Fremont, Calif.

[21] Appl. No.: 664,987

[22] Filed: Oct. 26, 1984

[51] Int. Cl.[4] ..... H01H 33/66

[52] U.S. Cl. ..... 200/144 B; 200/146 R

[58] Field of Search ..... 200/144 B, 146 R

[56] References Cited

U.S. PATENT DOCUMENTS

| | | | |
|---|---|---|---|
| 2,469,203 | 5/1949 | Palme et al. | 200/146 R |
| 2,838,636 | 6/1958 | Schwager | 200/144 B |
| 3,268,696 | 8/1966 | Lindell | 200/144 B |
| 4,110,579 | 8/1978 | Frink et al. | 200/146 R |

*Primary Examiner*—Robert S. Macon

*Attorney, Agent, or Firm*—Flehr, Hohbach, Test, Albritton & Herbert

[57] ABSTRACT

A switching apparatus for disconnecting and connecting power between a power source and a load employs a vacuum switch, a knife blade or air switch coupled electrically in series with the vacuum switch and a positive interlock mechanism. In the disconnect mode, at first the bias on a springloaded movable contact of the vacuum switch is relieved; then the vacuum lock that maintains the movable contact engaged with the fixed contact in the vacuum switch is overcome to cause complete separation of the contacts, thereby breaking the connection to the power source; and finally the knife blade is moved to open the air switch and to a position providing a visual indication that the power to the load has been interrupted. A continuous force is applied to the interlock mechanism, but the disconnect process occurs sequentially in three steps. During the connect mode, the three step process is reversed.

9 Claims, 6 Drawing Figures

HIGH POWER SWITCHING APPARATUS

DESCRIPTION

1. Technical Field

This invention relates to high power switching apparatus and in particular to a means for disconnecting or connecting a load to a power source.

An object of this invention is to provide an improved high power switching apparatus that minimzies arcing and burnout of switch components.

Another object of this invention is to provide a high power switching apparatus that is virtually fool-proof and ensures safety for an operator.

Another object of this invention is to provide a high power switching apparatus that operates relatively easily, with minimal noise and wherein gases are not generated, thereby maintaining a clean atmosphere.

2. Background Art

A commonly used type of high power switching apparatus or load interrupter employs a knife blade switch assembly that operates in an air or atmospheric environment. The switching assembly is generally massive, very noisy when operating, and subject to arcing and burnout. After a few hundred switching operations, the parts tend to degrade so that frequent maintenance and replacement of parts are needed. This condition becomes more critical in cases where the power is frequently and intermittently interrupted, such as occurs is steel mills and industrial plants where the power is not used continuously. Since the knife blade air switch is visible to the operator, an indication whether the power source is connected to the load is readily seen. However, because the knife blade must travel several inches through the air environment, the high voltage and current from the power source pose a problem of safety for the operator due to arcing that occurs before the conductive knife blade is sufficiently distanced from the electrical contacts which receive power from the source. At the very least, the contacts, the protective plastic insulating arc shoe, as well as other components burn out after a short period of time. In addition, it has been observed that noxious gases are generated when arcing occurs.

To overcome the deficiencies of the air switch, recent circuit breaker devices have employed vacuum switches. The vacuum switch is compact, less expensive and requires very small displacement of a movable contact to break the power to load connection. By virtue of the high vacuum, and the short movement of the contact to break the connection, and the high insulating material forming the vacuum enclosure, the problems of arcing, burn out, gas generation and most significantly the safety of the operator are virtually resolved. In addition these devices may employ an air switch to provide a visual indication that the device is in a disconnect status.

However, in these recent devices, the vacuum switch and air switch are operated independently. The operator requires a key for operating the vacuum switch separately, and then generally uses the same key to operate the air switch. The operating steps are independent and there is room for human error in operating the switches in the proper sequence during connect or disconnect modes.

SUMMARY OF THE INVENTION

A switching apparatus for interrupting power supply to a load employs a three-step action actuated by a single continuous one stroke motion to disconnect and connect the power source and the load. The apparatus includes a vacuum switch, a knife blade air switch and a positive interlock mechanism. The switches are disposed in an in-series configuration. A single shaft coupled to a camming device ensures that the vacuum switch is opened in two discrete steps or phases prior to the disconnection of the knife blade air switch, and that during the closing of the circuit the air switch is closed first. The positive interlock mechanism includes a camming device and a bell crank, among other things, and a bias spring for controlling the contact pressure of the movable contact relative to the fixed contact in the vacuum switch.

BRIEF DESCRIPTION OF THE DRAWINGS

The invention will be described in detail with reference to the drawing in which.

Similar numerals refer to similar elements throughout the drawings.

DESCRIPTION OF THE PREFERRED EMBODIMENT

Figure 1:
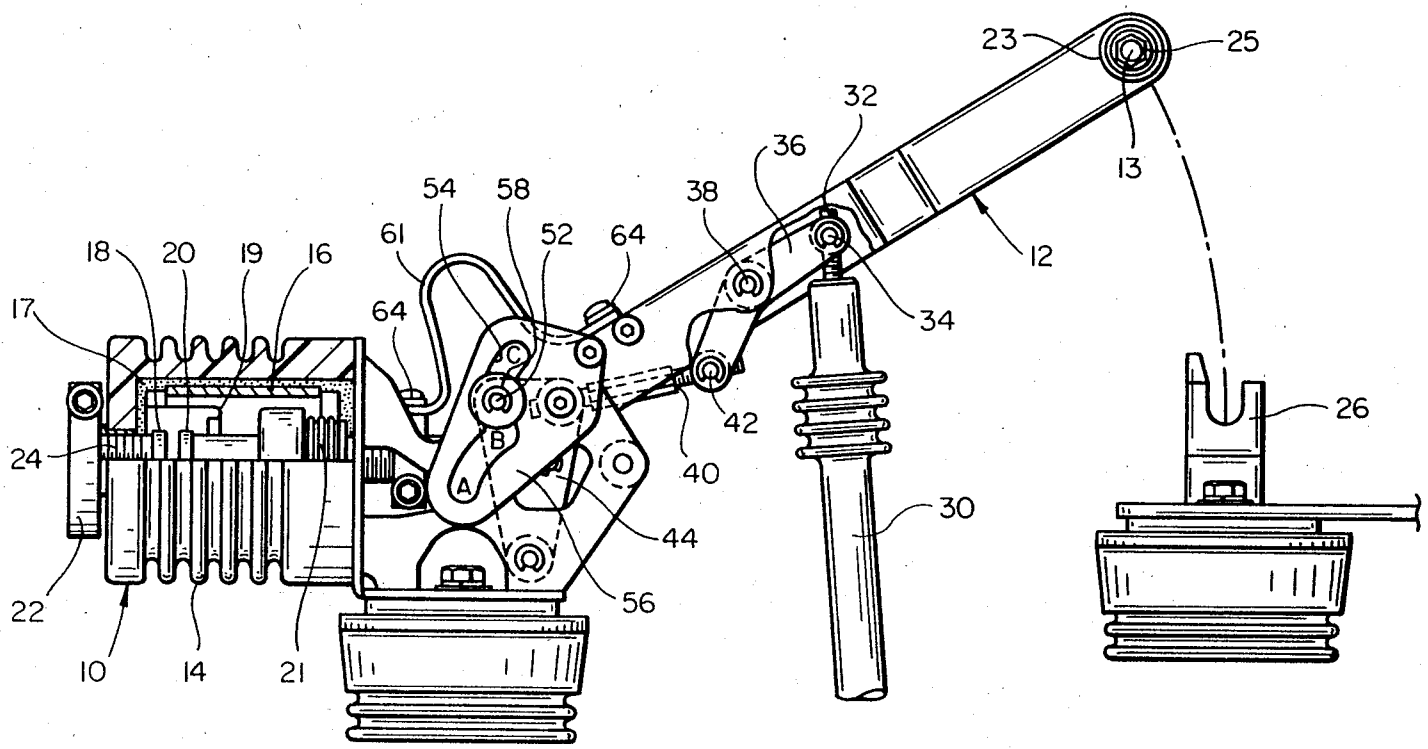
FIG. 1 is a schematic plan view of the switching apparatus of this invention, delineating the operation of the parts in the opening mode.

With reference to FIG. 1, a high power switching device incorporates a vacuum switch 10 and a knife blade assembly 12, having two spaced knife blades 12A and 12B. The blades are kept in spaced relation by spacer element 27. In addition, a knife blade shaft 13 associated with springs 23 and lock nuts 25 serve to keep the blades in spaced and fixed relation to each other.

The vacuum switch is attached by means of a threaded portion of the shaft 24 to a bus clamp 22, which is electrically connected to a power supply or source (not shown). The vacuum switch is formed with an epoxy insulator cylindrical housing 14 and a concentric inner porcelain envelope 16 which encloses the vacuum chamber. The vacuum in the chamber is relatively high, in the range of $10^{-5}$ to $10^{-7}$ Torr. A potting compound 17 is inserted between the insulator housing 14 and envelope 16. A shield 19 serves to prevent any metal deposition inside of the envelope 16 due to arcing.

Figure 2:
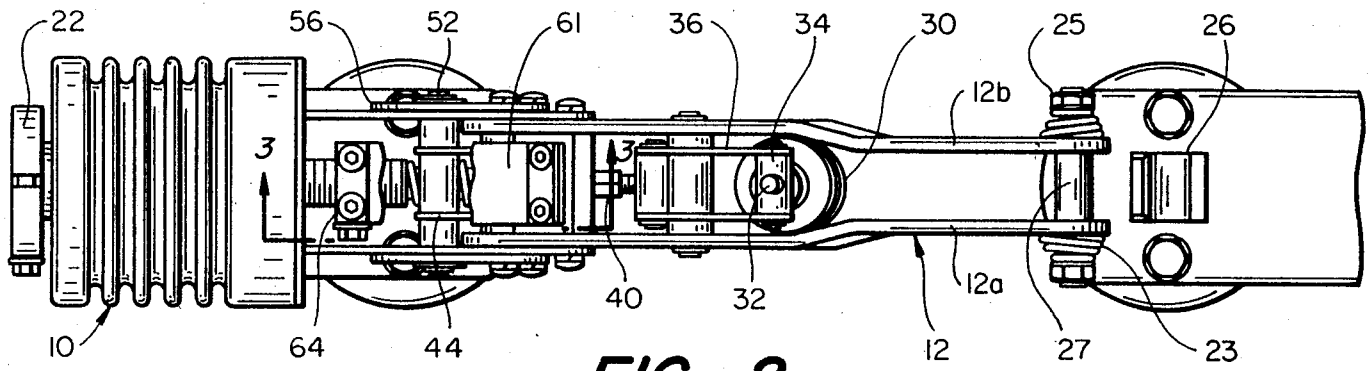
FIG. 2 is a top view of the apparatus of FIG. 1.
Figure 3:
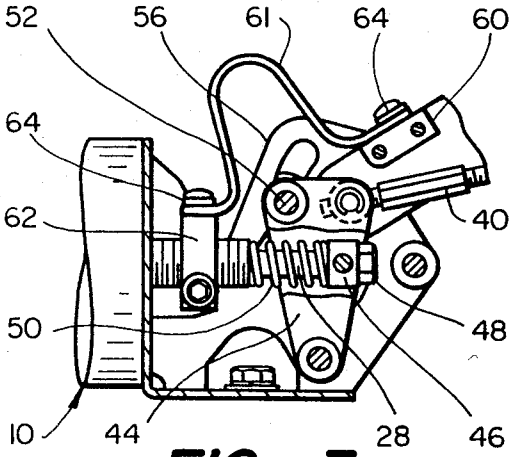
FIG. 3 is a sectional view taken along lines 3—3 of FIG. 2.

Within the vacuum chamber, a fixed electrical contact 18 and a movable contact 20 are positioned adjacent to each other. The contacts 18 and 20 are disposed within the high vacuum chamber wherein the vacuum serves as an effective insulator. The fixed contact 18 is electrically connected to the power source by means of the bus clamp 22, which is attached to a shaft 24 that supports the contact 18. When the power to load connection is closed, the contacts 18 and 20 abut; and when the connection is open, as shown in FIGS. 1 and 2, they are separated by about 0.25 inch, by way of example. Thus a small displacement of the movable contact is sufficient to open or close the power connection to a load that is connected to the electrical contact 26 and the knife blade 12. A bellows 21 allows the contact 20 to move without loss of vacuum from the chamber.

Since the housing 14 and porcelain envelope 16 are not transparent, and the movement of the movable contact 20 is minute during the breaking or connecting of the circuit, it is not possible for an operator to easily determine whether the shaft 28 to which the movable contact is joined has been retracted from the vacuum enclosure and whether the apparatus is in a connect or disconnect status.

However, the knife blade air switch assembly that is exposed to view is readily observable, and the operator can see whether the knife blade is connected to the load side contact 26.

In accordance with this invention, the disconnect and connect operations are conveniently achieved by means of the positive interlock mechanism located between the vacuum switch 10 and the knife blade air switch 12. For the disconnect operation, a simple one stroke applied force serves to effectuate three distinct sequential steps which (a) releases the spring bias forcing the movable contact 20 against the fixed contact 18 of the vacuum switch; then (b) retracts the movable contact away from the fixed contact; and finally (c) disengages the knife blade assembly from the stationary contact 26 at the load end of the aparatus.

With reference to FIGS. 1–5, a push rod 30 which is attached to the knife blade assembly is pushed upward by the operator. The rod 30 is connected to a shaft 32 and a push rod pivot 34. The applied upward force on the rod 30 is translated through the shaft 32 and pivot 34 to a bell crank mechanism 36 that rotates counterclockwise about a pivotable shaft 38. This causes a linkage shaft 40 to move downward about the pivot 42 so that a pivot wing 44 pivots clockwise. As a result, an interrupter pivot 46, illustrated in FIG. 3, acts to close the gap between the pivot 46 and a nut 48 attached to the end of shaft 28, by releasing the bias force of a bias spring 50 which is mounted on the shaft 28.

The bias spring is seated between the nut 48 and an aperture in the housing 14 that allows the bidirectional linear movement of the shaft 28 within the outer housing and within the sealed vacuum chamber of the switch 10.

Figure 4:
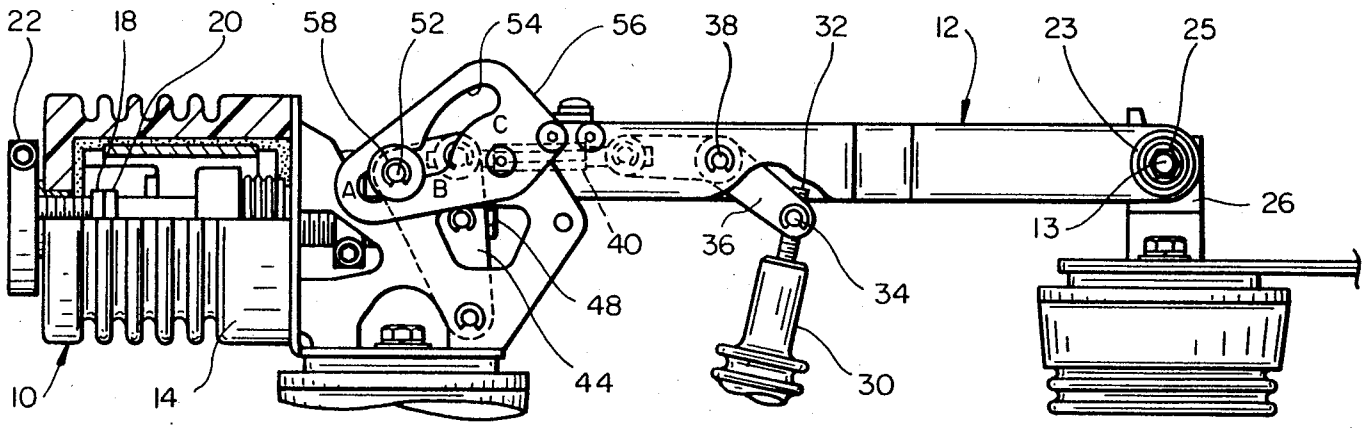
FIG. 4 is a schematic plan view of the inventive switching apparatus, depicting the parts in the closing mode.
Figure 5:
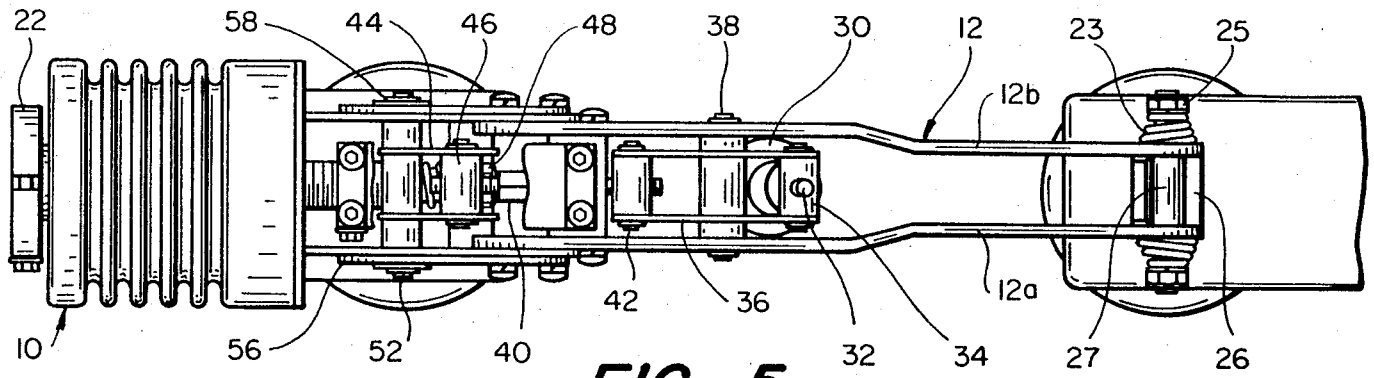
FIG. 5 is a top view of the apparatus of FIG. 4.

As the movable contact 20 is located at the end of the shaft 28 within the vacuum chamber, the bias force on the contact 20 from the spring 50 can be released. At this point which is the end of the first phase of the sequence, the contacts 18 and 20 still abut in conducting relation by virtue of a vacuum lock arising from the difference in pressure between the vacuum in the chamber and the external atmospheric environment, although the spring bias force no longer is being applied. Also, the knife blade assembly 12 still is seated in the stationary contact 26. In the closed circuit state, a roller shaft 52 that is coupled through a configured slot 54 in an interrupter activated cam 56 is fixed in position A, at the bottom of the slot on the configured slot. At the end of the first phase, when the spring 50 is no longer biased by the action of the pivot wing 44, the roller shaft is still in position A and the cam 56 is still oriented as illustrated in FIG. 4.

With the continuing application of the upward force on the push rod 30, the bell crank 36 continues to pivot, causing the movable contact 20 to move outwardly from the vacuum chamber. The pivoting of the bell crank 36 and downward movement of the linkage shaft 40, and pivoting of the pivot wing 44 result in a counterclockwise rotation of the activator cam 56 so that the roller shaft 52 is moved and guided to position B. A retainer ring 58 prevents the escape of the roller shaft 52 from the slot in the cam 56. At this point in the sequence, the contacts 18 and 20 of the vacuum switch are open or disconnected so that power to the load is interrupted.

After the second phase of the sequence has been completed, the continuing application of upward force on the push rod 30 causes the knife blade assembly 12 to move up, thereby disconnecting the blade assembly from the stationary terminal 26. Since the vacuum switch has previously been disconnected during the second phase, there is no problem of arcing and no danger presents itself to the operator. The knife blade assembly now is in a position well removed from the terminal 26, more than five inches for example, and the operator has a clear visual indication of the disconnection. Furthermore, there is no concern that the high power current or voltage, which may be in the order of 600 amps and 15,000 volts respectively, will be present at the load end of the apparatus. During this third phase of the sequence, the roller shaft 52 moves along the guide slot of the cam 56 toposition C and locks the vacuum interrupter contact 20 in the open position. To make a reconnection between the power and the load, the sequence of three phases or steps is reversed, while the operator pulls the push rod down in a continuous one stroke motion. A retraction of the push rod causes the knife blade assembly 12 to move downwardly, and thereby results in seating the knife blades in the stationary terminal 26. The pivot wing 44 and wing roller follow the cam 56 to the center position B. At this point, the vacuum switch contacts 18 and 20 are in close contact, but in an unbiased state. It should be noted that the knife blade assembly has made contact with the electrical terminal 26 before the vacuum switch contacts have met during the close mode.

After the contacts have made an electrical connection, the bell crank 36 pivots clockwise, causing the linkage shaft 40 to move upward, thereby pushing pivot wing 44 linearly towards the vacuum switch 10. The wing roller follows the activator cam 56 to the closed position A, which causes the biasing of spring 50 and the locking of knife blades 12 in a closed position. Bell crank 36 continues to rotate clockwise and overtoggles to a position that locks the vacuum switch contacts 18 and 20 closed in a biased position.

To provide the necessary electrical power continuity from the power source to the load, the components of the apparatus are made of electrically conducting materials, such as copper or steel, except where insulation is required. For this purpose, electrical foil connectors 60 and 62 are provided between the knife blades and the vacuum switch. The electrical foil connector 60 serves as a limiter or stop for the linkage shaft 40, which in turn limits the extent of travel of the bell crank 36. Foil retainers 64 provide a constant uniform pressure to the foil connectors so as to maintain an electrical connection between the blade switch and the vacuum switch. In this position, the combination of the bell crank and spring 50 are fixed and the movable contact 20 of the vacuum switch securely contacts the fixed contact 18.

Figure 6:
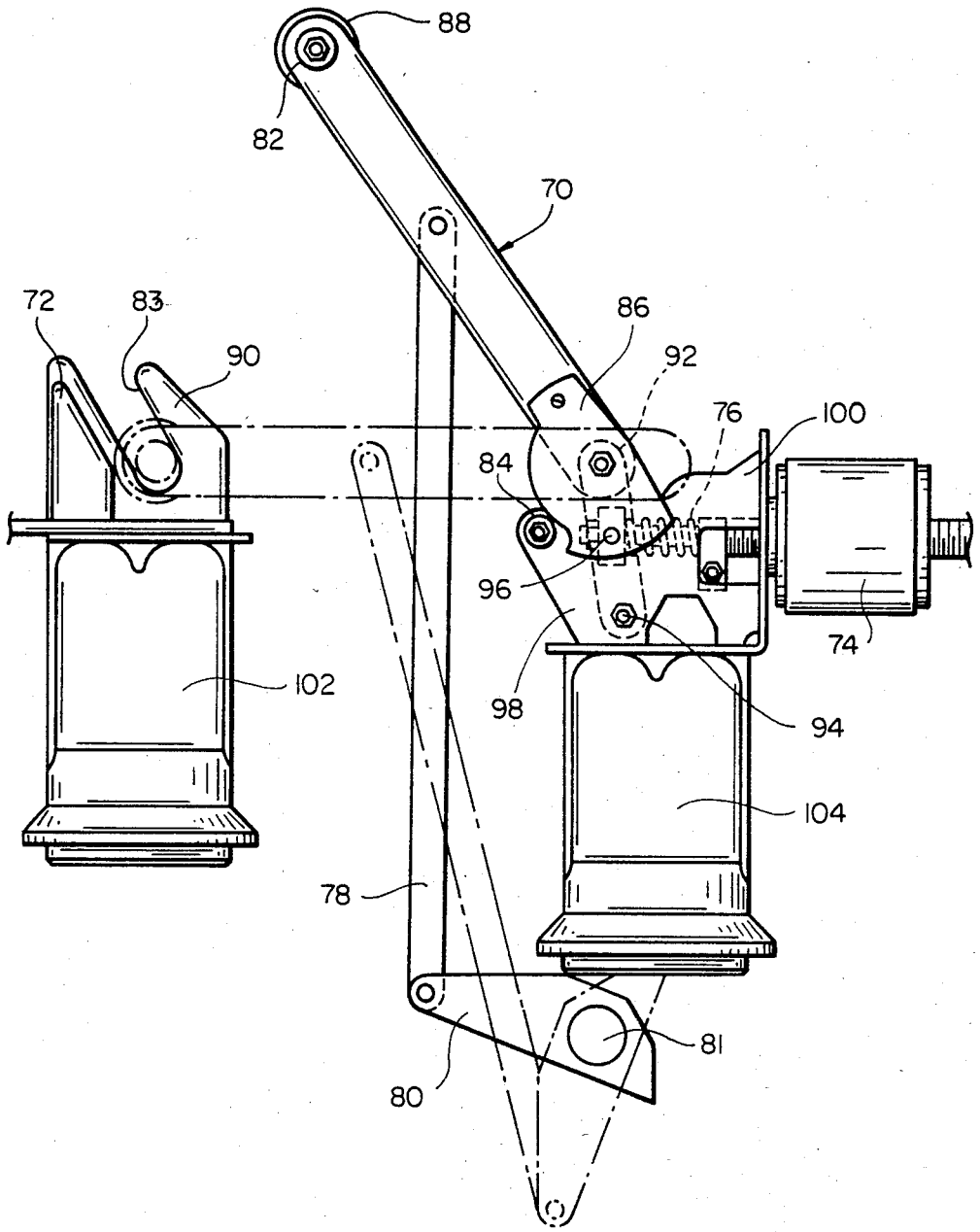
FIG. 6 is a schematic plan view of an alternative embodiment of this invention.

An alternative high power switching apparatus is illustrated in FIG. 6. The apparatus is shown in the open position with the knife blade air assembly 70 disconnected from a stationary terminal 72. The movable contact of a vacuum switch 74 is displaced from the fixed contact and not biased by a bias spring 76. Dashed line representations indicate the closed position of the various elements.

During the closing sequence, a push rod 78 connected to an ear 80 and a the knife assembly 70 is pulled downward thereby moving the bearing roller 82 into the seating slots 83 of the stationary terminal 72, which is connected to a utilization load (not shown). The ear 80 rotates around a main shaft 81 and is shown in the open position.

During this pase of the sequence, a cam follower bearing 84 rides on the surface of a cam 86 to allow smooth movement of the knife blade assembly without binding. Two rollers 88 associated with the knife blade assembly slide between the slots 83 of the cam 90.

With the downward motion of the knife blades, a pivot wing 92 is caused to move towards the vacuum interrupter switch 74, rotating clockwise about pivot 94. With this movement, a pin 96 rides along the periphery of a configured bracket 98 to which the vacuum switch is mounted. When the blade rollers 88 are near the bottom position in the slots 83, the pin 96 rides over into the horizontal portion 100 of the configured bracket 98. At this point, the action of the pin causes the movable contact to contact the fixed contact within the vacuum switch, and to bias the spring 76 so as to hold the movable contact in tight engagement with the fixed contact. Insulator stands 102 and 104 are provided as supports for the switches and the interlock assembly.

To open the power to load connection, the push rod 78 is pushed upwards continuously, and the sequence of steps is reversed so that the vacuum switch is disconnected before the knife blade air switch is opened.

There has been described herein a high power switching apparatus wherein a single continuous one stroke operator motion translates to a sequence of three distinct steps for connecting or disconnecting a high power source to a utilization load. The switching appratus provides a high degree of safety and is virtually foolproof against shock hazards, as well as being compact, relatively quiet and clean and affording long life operation.

What is claimed is:

1. A high power switching apparatus comprising:

a vacuum switch means having a fixed electrical contact and a movable electrical contact;

bias means for biasing said movable contact towards said fixed contact;

an air switch having a knife blade assembly and an electrical terminal for engaging said knife blade assembly;

a positive interlock mechanism disposed between said switches, comprising;

an actuating mechanism for applying a continuous one stroke force for first relieving the bias of said bias means; then retracting said movable contact from said fixed contact, and then disengaging said knife blade assembly from said terminal; said steps occurring in sequence during a disconnect mode; and during the connect mode first connecting the knife blade assembly and terminal then advancing said movable contact into position against said fixed contact, and then applying a bias force from said bias means to force said movable contact securely against said fixed contact.

2. An apparatus as in claim 1, wherein said bias means includes a bias spring.

3. An aparatus as in claim 1, wherein said actuating mechanism comprises a push rod coupled to said knife blade assembly for enabling a continuous one stroke operator motion to realize connection or disconnection of said load and power source.

4. An apparatus as in claim 3, further including a pivotable bell crank responsive to said push rod;

camming means coupled to said knife blade assembly and said bell crank; and a pivot wing coupled to said camming means so that motion of said push rod disconnects said contacts of said vacuum switch in two discrete steps, followed by a third step in which said knife blade assembly is disconnected from said terminal during the disconnect mode.

5. An apparatus as in claim 4, wherein said pivot wing has a configured slot, and wherein said interlock mechanism comprises a shaft roller that is positioned at three discrete points in seriatim during the connect or disconnect modes, such three position points in said configured slot being correlated to the three steps of the connect or disconnect sequence.

6. An apparatus as in claim 1, wherein said switches are arranged in electrical series.

7. An apparatus as in claim 1, wherein the displacement of said movable contact during disconection or connection is about 0.25 inch.

8. A method of disconnecting a utilization load from a high power source wherein a vacuum switch, a knife blade air switch and a positive mechanical interlock are coupled in a serial configuration between the load and the power source,and the vacuum switch has a fixed contact and a spring biased movable contact in close engagement, said vacuum switch being coupled to the power source, and the air switch is coupled to the load, comprising the steps of:

removing the sping bias from said movable contact;

retracting the movable contact from said fixed contact thereby breaking the connection of said vacuum switch to said power source; and displacing the knife blade from the load terminal.

9. A method of connecting a utilization load to a high power source, wherein the sequence of three discrete steps set forth in claim 8 are reversed.

* * * * *